US009574804B2

(12) United States Patent
Dreossi et al.

(10) Patent No.: US 9,574,804 B2
(45) Date of Patent: Feb. 21, 2017

(54) HOUSEHOLD APPLIANCE

(75) Inventors: Giuseppe Dreossi, Stockholm (SE); Bernd Krische, Saltsjoe-Boo (SE); Richard Furberg, Akersberga (SE)

(73) Assignee: Electrolux Home Products Corporation N.V., Brussels (BE)

( * ) Notice: Subject to any disclaimer, the term of this patent is extended or adjusted under 35 U.S.C. 154(b) by 672 days.

(21) Appl. No.: 13/977,244

(22) PCT Filed: Dec. 20, 2011

(86) PCT No.: PCT/EP2011/073481

§ 371 (c)(1), (2), (4) Date: Aug. 6, 2013

(87) PCT Pub. No.: WO2012/089569

PCT Pub. Date: Jul. 5, 2012

(65) Prior Publication Data

US 2013/0305747 A1 Nov. 21, 2013

(30) Foreign Application Priority Data

Dec. 29, 2010 (EP) ..... 10016167

(51) Int. Cl.
*F25B 27/00* (2006.01)
*F25B 30/00* (2006.01)
(Continued)

(52) U.S. Cl.
CPC ..... *F25B 30/00* (2013.01); *D06F 58/206* (2013.01); *A47L 15/4285* (2013.01);
(Continued)

(58) Field of Classification Search
CPC ..... D06F 58/206; D06F 58/24; D06F 58/26; A47L 15/4285; A47L 15/4291;
(Continued)

(56) References Cited

U.S. PATENT DOCUMENTS 6,151,795 A * 11/2000 Hoffman ..... D06F 58/12 34/605
2005/0066538 A1* 3/2005 Goldberg ..... D06F 5/00 34/218
(Continued)

FOREIGN PATENT DOCUMENTS

EP 2193741 A2 6/2010
EP 2206824 A2 7/2010
(Continued)

OTHER PUBLICATIONS

Translation of EP2193741 and EP2206824 cited in the IDS.*
(Continued)

*Primary Examiner* — Jonathan Bradford
*Assistant Examiner* — Elizabeth Martin
(74) *Attorney, Agent, or Firm* — Alston & Bird LLP

(57) ABSTRACT

Provided herein are a household appliance and a method for using a heat pump in a household appliance, which may include a household appliance for washing and drying goods. The household appliance may include a processing chamber for receiving goods to be washed and dried, and a heat pump having a warm side provided with a condenser and a cold side provided with an evaporator, wherein the condenser may be adapted to heat water to be used in the processing chamber and the evaporator may be adapted to cool a liquid in a heat reservoir for storing heat generated on the cold side of the heat pump during heating of the condenser. The condenser may be arranged in a water tank adapted to provide water to the processing chamber.

20 Claims, 3 Drawing Sheets

(51) Int. Cl.

| | |
|---|---|
| ***D06F 58/20*** | (2006.01) |
| *A47L 15/42* | (2006.01) |
| *A47L 15/48* | (2006.01) |
| *D06F 58/24* | (2006.01) |

(52) U.S. Cl.
CPC ..... *A47L 15/4291* (2013.01); *A47L 15/483* (2013.01); *D06F 58/24* (2013.01)

(58) Field of Classification Search
CPC ..... A47L 15/483; F25B 30/00; F25B 2400/0403; F25B 2400/0409
See application file for complete search history.

(56) References Cited

U.S. PATENT DOCUMENTS

2008/0235977 A1* 10/2008 Kuwabara ..... D06F 28/206 34/77
2009/0178442 A1* 7/2009 Kawabata ..... D06F 9/083 68/20
2009/0242005 A1* 10/2009 Gaus ..... A47L 15/4285 134/57 D

FOREIGN PATENT DOCUMENTS

| | | |
|---|---|---|
| JP | 2009/213531 A | 9/2009 |
| WO | WO 2006/069834 A1 | 7/2006 |
| WO | WO 2008/053307 A1 | 5/2008 |

OTHER PUBLICATIONS

International Searching Authority, International Search Report for International Application No. PCT/EP2011/073481, mailed Jul. 16, 2012, 3 pages, European Patent Office, The Netherlands.
International Searching Authority, International Preliminary Report on Patentability for International Application No. PCT/EP2011/073481, issued Jul. 2, 2013, 6 pages.
International Searching Authority, Written Opinion for International Application No. PCT/EP2011/073481, issed Jul. 2, 2013, 5 pages.

* cited by examiner

HOUSEHOLD APPLIANCE

CROSS REFERENCE TO RELATED APPLICATIONS

This application is a national stage application, filed under 35 U.S.C. §371, of International Application No. PCT/EP2011/073481, filed Dec. 10, 2011, which claims priority to European Patent Application No. 10016167.8, filed Dec. 29, 2010, both of which are hereby incorporated by reference in their entirety.

TECHNICAL FIELD

The present invention relates to a household appliance and a method for using a heat pump in a household appliance, and more particularly to a household appliance for washing and drying goods. The invention is intended for use particularly but not exclusively in a dishwasher or in a washer-dryer.

BACKGROUND

In a dishwasher, the heating of water to be used in the washing process and heating and drying of goods are energy consuming processes. A washer-dryer involves similar processing steps in which water is heated to perform washing of goods, i.e. clothes, and heating and condensation in the following drying step. Generally, the heating of goods and water in a household appliance for washing and drying goods is performed by for example an electric heater heating the water in the washing tub. For performing the drying phase a separate drying system is generally installed, for example by using a hot air source.

In order to save energy, it has been proposed to use a heat pump having a warm side which may be used for heating goods and water and a cold side which may be used for condensing water vapour in a drying phase. In this way a single unit, i.e. the heat pump may be used for two purposes.

In WO2008/053307A1 a dishwasher and a heat pump for dishwashing is described. The described dishwasher comprises a washing portion and a rinsing portion, both arranged in a tunnel. Thus, the dishwasher simultaneously performs a washing cycle in the washing portion and a rinsing and drying cycle in the rinsing portion. The heat pump is provided with a condenser for heating water to the washing portion of the dishwasher and an evaporator for cooling the outlet air from the rinsing portion of the dishwasher. In this way both the warm side and the cold side of the heat pump may be utilized.

However, in most dishwashers the heating of water and goods is earlier in time than the drying phase. Using a heat pump for heating the water in such an appliance has the drawback that the heat generated on the cold side during the water heating phase will not be used and therefore utilization of a heat pump in an energy efficient way for both purposes is not possible.

EP2206824A2 discloses a device comprising a barrel for processing washing goods, and a closed tank filled with liquid. A compressor, a condenser, an expansion valve and an evaporator extract heat from the tank, and supply the heat to the barrel. A sewer pipe discharges process water from the barrel, and a heat exchanger transfers heat from sewage in the fluid in the tank.

Further, in EP2193741A2 a dishwasher is disclosed comprising a heat pump used for heating water in a process area for washing and/or rinsing articles and for accumulating heat in a heat accumulator. A side of a heat coupling tank is joined at the process area and another side of the heat coupling tank is joined at the heat accumulator. A filling medium is provided for program controlled supplying and guiding coupling fluid in or from the heat coupling tank. In the filled state, the heat coupling tank may be used in a drying phase for establishing a cold area onto which water vapour may condense.

A drawback with the above arrangements is that the heating phase for the machine will be prolonged due to the lower effect of the heat pump compared to a conventional heating device. On the other hand, if the heating power of the heat pump is chosen to be the same as a conventional heater, i.e. about 2 kW, such a heat pump will have a size that will be difficult to fit into a domestic dishwasher or washing machine.

In view of the above it may be realized that there is a need for improvements in relation to efficient use of energy in household appliances involving both heating and drying phases.

SUMMARY

An object with the present invention is to provide an energy efficient household appliance for washing and drying goods.

A further object with the present invention is to provide a household appliance for washing and drying goods that has an effective condensation drying system.

Another object with the present invention is to provide efficient use of a heat pump in a household appliance in which a heating and washing phase and a drying phase are separated in time.

At least one of the above objects are achieved by a household appliance for washing and drying goods, comprising a processing chamber for receiving goods to be washed and dried, and a heat pump having a warm side provided with a condenser and a cold side provided with an evaporator. The condenser is adapted to heat water to be used in the processing chamber and the evaporator is adapted to cool a liquid in a heat reservoir for storing heat generated on the cold side of the heat pump during heating with the condenser, wherein the condenser is arranged in a water tank adapted to provide water to the processing chamber.

To make it possible to implement a heat pump for heating water into a household appliance without prolonging the program time considerably, a water tank filled with water to be used in the process chamber is introduced that may be heated during washing and/or rinsing operations of the machine. When needed, the heated water is then introduced into the tub and processing chamber. Thus, the available time for heating is much longer than in prior art appliances and the heat pump can thus be much smaller and may have a heating power of less than 1/10 of using a heat pump for direct heating. To reach the intended peak temperatures, a conventional electrical heater is used as a complement. The conventional electric heater may be positioned in the bottom of the processing chamber. The heat pump does not completely substitute the conventional heater but assists it so it may operate for shorter time periods or have a smaller heating power. In effect, the total energy consumption is considerably smaller than with an electric heater alone.

The heat reservoir arranged in the household appliance provides the possibility to store heat in the form of cooled or frozen liquid. By arranging a heat reservoir for storing cooled or frozen liquid and a water tank for providing heated water, it is possible to arrange an energy efficient use of the heat pump. Further, heating with a heat pump is achieved without the side effect of cooling down the surrounding air and environment and the corresponding air flows.

Since the stored heat may be used later for drying goods that has been washed, an efficient use of a heat pump in a household appliance is provided for.

As a result, at least one of the above mentioned objects are achieved.

According to an embodiment, a heat exchanging device is arranged to the heat reservoir and the heat exchanging device provides a surface for condensing thereon water vapour from the processing chamber during drying of the goods in the processing chamber. Further, the heat exchanging device comprises a cooling conduit which is connected to the heat reservoir and is at least partly arranged inside the heat reservoir.

The heat stored in the heat reservoir in the form of cooled or frozen liquid may now be used in a drying phase following after a washing phase. The cooling power of the loaded heat reservoir provides efficient condensation drying in the drying phase. Thanks to efficient condensation the drying temperature may be lowered. The heat reservoir is regenerated by the heat energy from condensing water out of the air in the processing chamber during the drying phase. This facilitates drying at lower temperatures than otherwise possible in closed condensation systems. Another advantage is that the heat pump may be smaller than otherwise needed to generate the sufficient cooling power to achieve condensation drying.

According to another embodiment, the cooling conduit comprises a pump for circulating a heat transfer liquid through the cooling conduit such that the heat transfer liquid is cooled while passing through the heat reservoir.

The pump is activated just before or at the start of the drying phase. By circulating a heat transfer fluid in the cooling conduit the stored heat in the heat reservoir is transferred out to the heat exchanging device.

According to another embodiment, the cooling conduit is spirally shaped in the heat reservoir.

By forcing the heat transfer fluid through a spirally shaped cooling conduit in the heat reservoir an effective cooling is obtained to the heat transfer fluid.

According to another embodiment, the heat exchanging device is a heat pipe or a thermosiphon.

A heat pipe is existing technology which uses a self-contained length of tube with no mechanical moving parts. Heat pipes are filled with suitable working fluids, evacuated, and sealed on both ends. The heat pipe transfers heat by absorbing heat at one end (evaporator) and releasing heat at the other end (condenser). The heat pipe may include a wick of appropriate design to promote the return of condensed fluid through capillary forces. Although similar in form and operation to heat pipes, thermosiphon tubes are different in that they have no wicks and hence rely only on gravity to return the condensate to the evaporator, whereas heat pipes use capillary forces. Thermosiphon tubes require no pump to circulate the working fluid. However, the geometric configuration must be such that liquid working fluid is always present in the evaporator section of the heat exchanger.

By using a heat pipe or thermosiphon as heat exchanging device, there is no need for auxiliary electrical driven components, such as the pump. Further, very high heat transfer rates may be obtained.

According to another embodiment, the heat exchanging device is arranged within the processing chamber. Further, the heat reservoir is arranged outside the processing chamber.

By arranging the heat reservoir outside the processing chamber of the household appliance a reduction of the usable interior space is avoided. Furthermore, any heat losses during heating phases may be more easily prevented.

According to still another embodiment, the heat reservoir is arranged within the processing chamber. Further, the heat reservoir comprises a condenser surface onto which water vapour from the processing chamber condenses during drying of the goods in the processing chamber.

An advantage with this arrangement is that it is a simple but yet robust construction. As no cooling conduit or pump is required, the construction is also uncomplicated.

According to another embodiment, the appliance comprises an air flow generating device for directing air and/or water vapour towards the heat exchanging device or condenser surface.

By arranging an air flow generating device the condensing of water vapour is enhanced. Thus, the drying process may be speeded up.

According to another embodiment, the liquid in the heat reservoir is water.

Thermodynamically, water is among the best liquids for storing heat and latent heat due to its large enthalpy value for the phase change from liquid to solid and vice versa. Therefore, excellent storage density of heat is provided with water in the heat reservoir. When the evaporator cools the water inside the heat reservoir, ice will form around the evaporator. Depending on how long the heat pump operates, the heat reservoir may be filled with ice or ice and cooled water. Though described here for water, other substances with suitable phase change characteristics can be employed, even the phase change gas/liquid.

According to another embodiment, the household appliance is a dishwasher for washing, rinsing and drying dish goods.

According to another embodiment, the household appliance is a washer-dryer for washing, rinsing and drying laundry.

In a further aspect, at least one of the above mentioned objects are achieved by a method for using a heat pump in a household appliance. The household appliance comprising a processing chamber for receiving goods to be washed and dried, a water tank for holding water to be used in the processing chamber and the heat pump comprising a condenser and an evaporator, the method comprises the steps of:

heating water in the tank with the condenser, cooling a liquid in a heat reservoir with the evaporator, and storing heat in the form of cooled or frozen liquid in the heat reservoir.

Moreover, the method comprises a further step of:

condensing water vapour from the processing chamber on a heat exchanging surface arranged in contact with the heat reservoir.

Further features of, and advantages with, the present invention will become apparent when studying the appended claims and the following description. Those skilled in the art realize that different features of the present invention may be combined to create embodiments other than those described in the following, without departing from the scope of the present invention, as defined by the appended claims.

By the expression "to store heat" as used herein, is meant to make it possible to use energy generated at a certain time at a later occasion. The heat energy generated is stored in the form of a cooled or frozen liquid or a liquefied gas.

By the expression "condenser" as used herein, is meant a heating tube arrangement adapted to deliver heat. The condenser may be filled with a refrigerant that condenses inside the condenser.

By the expression "evaporator" as used herein, is meant a cooling tube arrangement adapted to deliver cold. The evaporator may be filled with a refrigerant that evaporates inside the evaporator.

However, for heat pumps using refrigerants that operate non-conventional cycles, as for instance carbon dioxide in transcritical mode, the state of the refrigerant inside condenser and evaporator may differ from above definitions of condenser and evaporator. Nevertheless such use of condenser/evaporator will also be incorporated herein.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
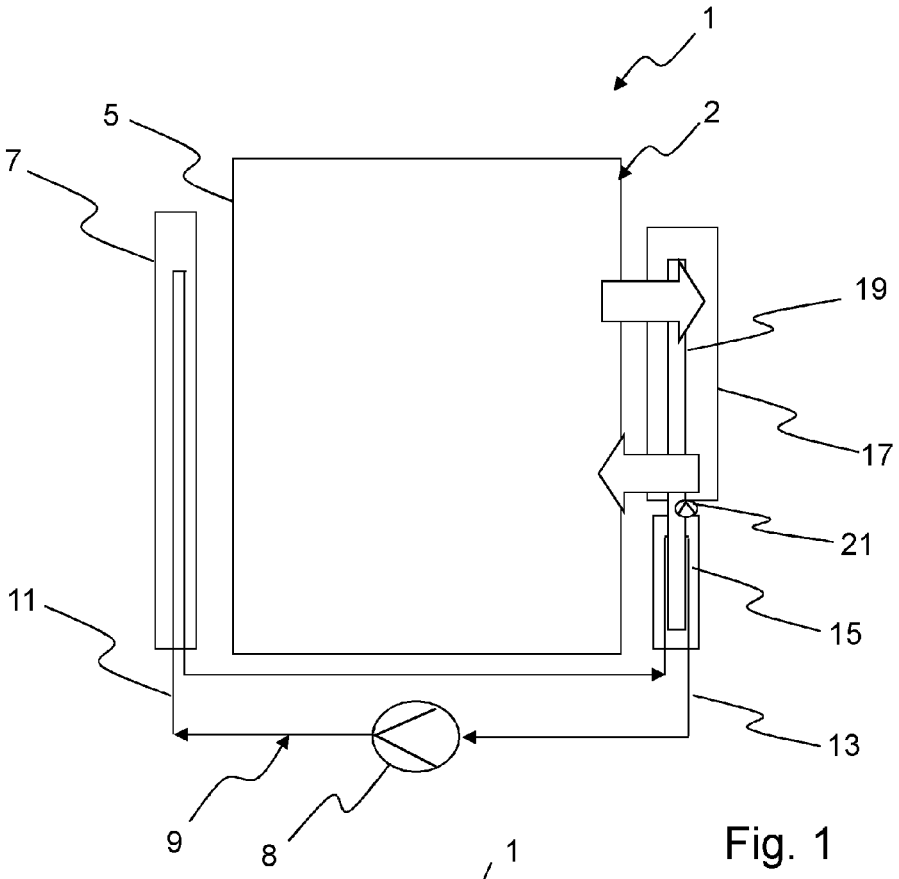
FIG. 1 is a schematic illustration of a household appliance, i.e. a dishwasher, according to an embodiment.

The present invention now will be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Throughout the following description similar reference numerals have been used to denote similar elements, parts, items or features, when applicable.

Figure 2:
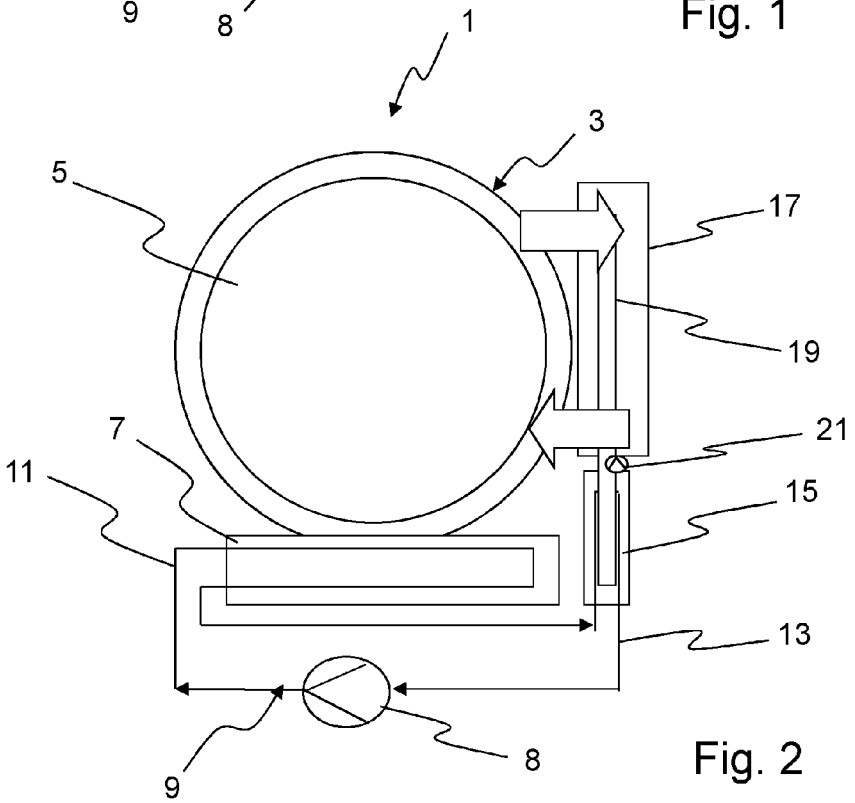
FIG. 2 is a schematic illustration of a household appliance, i.e. a washer-dryer, according to an embodiment.

In FIGS. 1-2 schematic drawings of household appliances 1 are illustrated. In FIG. 1 a dishwasher 2 is schematically shown. In FIG. 2 a washer-dryer 3 is schematically shown. In both these household appliances washing and drying of goods take place. In the washing phase warm water together with a detergent are used to wash and thereby remove dirt from the goods in a processing chamber. In a later following drying phase, the goods are dried and hot water vapour is to be removed from the processing chamber.

In FIG. 1 the dishwasher 2 comprises a processing chamber 5 to be loaded with dish goods. The dish washer further comprises a water tank 7 providing water to be used in the washing of the goods. To warm the water in the water tank, a heat pump 9 is arranged in the household appliance. Depending on program design, heat pump power, and wash temperature, the heat pump alone might be insufficient to heat up the water to the intended process temperature in the available time. Therefore, a conventional electrical heater (not shown) may be comprised in the household appliance as well. The heat pump 9 comprises a condenser 11, representing the warm side of the heat pump and an evaporator 13, representing the cold side of the heat pump. The condenser 11 is arranged in the water tank 7 for warming the water therein. The evaporator 13 is arranged in a heat reservoir 15. The heat reservoir may be a closed container which is filled with a liquid. The liquid in the heat reservoir may be water. However, it should be noted that other types of liquids or phase change materials may be chosen that have phase transition temperatures/enthalpies and/or specific heat in a suitable range in relation to the particular household appliance.

The water tank 7 may be designed to be separate from the processing chamber 5 and thus arranged outside the processing chamber. However, it should be noted that the water tank may be designed to be integrated completely or partially into the processing chamber, for example in that the water tank is formed in the bottom region of the processing chamber but still as a separate space.

The condenser/evaporator 11, 13 being arranged as a condenser/evaporator conduit is filled with a heat transfer fluid, such as a refrigerant. The heat pump 9 further comprises a compressor (8) and a pressure lowering device, such as an expansion valve (not shown). In a working mode of the heat pump, heat is generated on the warm side, i.e. in the condenser and cold is generated on the cold side, i.e. in the evaporator. The warm condenser warms up the water in the water tank and, at the same time, the cold evaporator cools the liquid in the heat reservoir. In the heat reservoir 15, a layer of frozen liquid builds up around the evaporator 13. In the case the heat reservoir is filled with water, ice is formed in the heat reservoir. Depending on the cooling effect in the evaporator and the time used to heat the water in the tank, the amount of ice in the heat reservoir may vary. The ice formed in the heat reservoir 15 is stored during the washing cycle. It should be noted that the liquid in the heat reservoir may be storing heat without being frozen. Depending on the type of liquid provided in the heat reservoir, the liquid may be cooled, also under zero degrees Celsius, without freezing.

A heat exchanging device 17 is arranged in connection with the heat reservoir 15. The heat exchanging device comprises a cooling conduit 19. The cooling conduit is arranged in the heat reservoir. A pump 21 is arranged to the cooling conduit for circulating the heat exchanging fluid to and from the heat reservoir. The flow of cold heat transfer fluid in the cooling conduit cools the cooling conduit as well as the heat exchanging device connected thereto. The heat exchanging device may comprise cooling flanges or other area enlarging means (not shown) to provide a large area or surface for heat transfer. When the washing phase is terminated, the goods in the processing chamber should be dried. In the dishwasher, drying is performed by removing hot water vapour from the processing chamber. By moving the air in the processing chamber towards the heat exchanging device, a flow of air containing hot water vapour meets the cold surface of the heat exchanging device. The hot water vapour condenses on surfaces of the heat exchanging device. The air flow then returns back to the processing chamber. Condensed water is returned back to the bottom of the processing chamber via a condensed water outlet (not shown). The drying of the air is illustrated by two arrows in FIGS. 1-2. Depending on the temperature of the final rinse, the heat stored in the dishes and structural parts of the processing chamber might be insufficient to warm up the return air from the heat exchanger and sustain further evaporation of water (drying). Additional heating of the return air by the heat pump or other means is needed and implemented in such cases.

The washer-dryer illustrated in FIG. 2 comprises a processing chamber 5 in the form of a rotatable drum into which the wash goods are loaded. Moreover, the washer-dryer comprises the same general parts as described above in relation with the dishwasher of FIG. 1. Accordingly, the described features and processes also apply to the washer-dryer according to FIG. 2.

Figure 3:
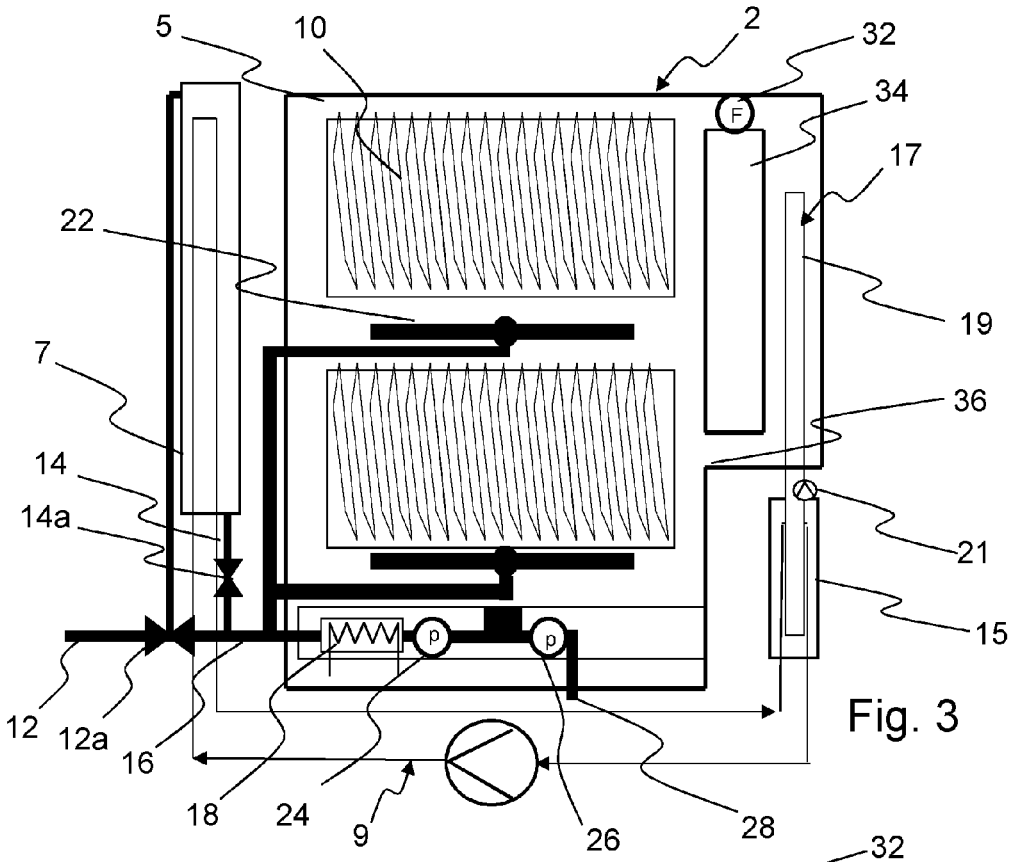
FIG. 3 shows a dishwasher according an embodiment.

In FIG. 3 a dishwasher 2 is illustrated according to an embodiment of the invention. The dishwasher comprises a processing chamber 5 in which dish goods 10 such as plates, bowls, cutlery and the like are placed to be washed. In the washing procedure a wash liquid, normally water and a detergent are moved around in the processing chamber. A water tank 7 is arranged at a side of the processing chamber. Water in the tank is heated before it is introduced into the processing chamber 5. Water is introduced to the water tank 7 from a main water inlet 12. From the main water inlet, water may be distributed to the water tank and/or directly into the processing chamber, optionally via a softening device to reduce its hardness. An inlet valve 12*a* is provided to be able to control the distribution of inlet water. Warm water leaves the water tank 7 through a tank outlet 14. A tank outlet valve 14*a* is provided in a water pipe 16 providing water to the processing chamber. If necessary, the warm inlet water may be mixed with more water directly from the main water inlet 12. In the bottom of the processing chamber 5 a heater device 18 is arranged for heating water in the bottom of the process chamber. Depending on the type of wash program selected, extra heating of the water may be required as the heat pump alone might be insufficient to heat up the water in the tank 7 to the intended process temperature in the available time. For distribution of the water in the processing chamber at least one wash arm 22 is provided. Water or wash liquid is distributed to the wash arm 22 by a wash liquid pump 24. For emptying wash liquid or water from the processing chamber 5 a drain pump 26 is used. The drain pump 26 is arranged in the bottom of the processing chamber and is connected to a processing chamber outlet 28.

As described with reference to FIGS. 1-2, the liquid in the heat reservoir 15 has been cooled by the evaporator 13 at the same time as the water in the water tank was heated by the condenser 11 during the working phase of the heat pump 9. In the embodiment shown in FIG. 3 the heat reservoir 15 is arranged outside the processing chamber 5. A cooling conduit 19 is arranged within the heat reservoir 15 and extends into the processing chamber 5. A partitioning wall 34 separates the cooling conduit 19 from the main part of the processing chamber. The cooling conduit 19 is thereby protected from the washing liquid circulating in the processing chamber during the washing phase.

To start the drying phase, an air flow generating device 32, e.g. a fan, directs air and water vapour from the processing chamber towards the cooling circuit 19. By circulating a heat exchanging fluid in the cooling conduit with a pump 21 the outer surface of the cooling conduit is kept cool. The water vapour is directed towards the cooling conduit and water vapour condenses on the outer surface of the cooling conduit. The condense water runs off the cooling circuit and is drained back to the processing chamber through a condense water outlet 36. The pump 21 may be started at the same time as the air flow generating device 32 or just before.

Figure 4:
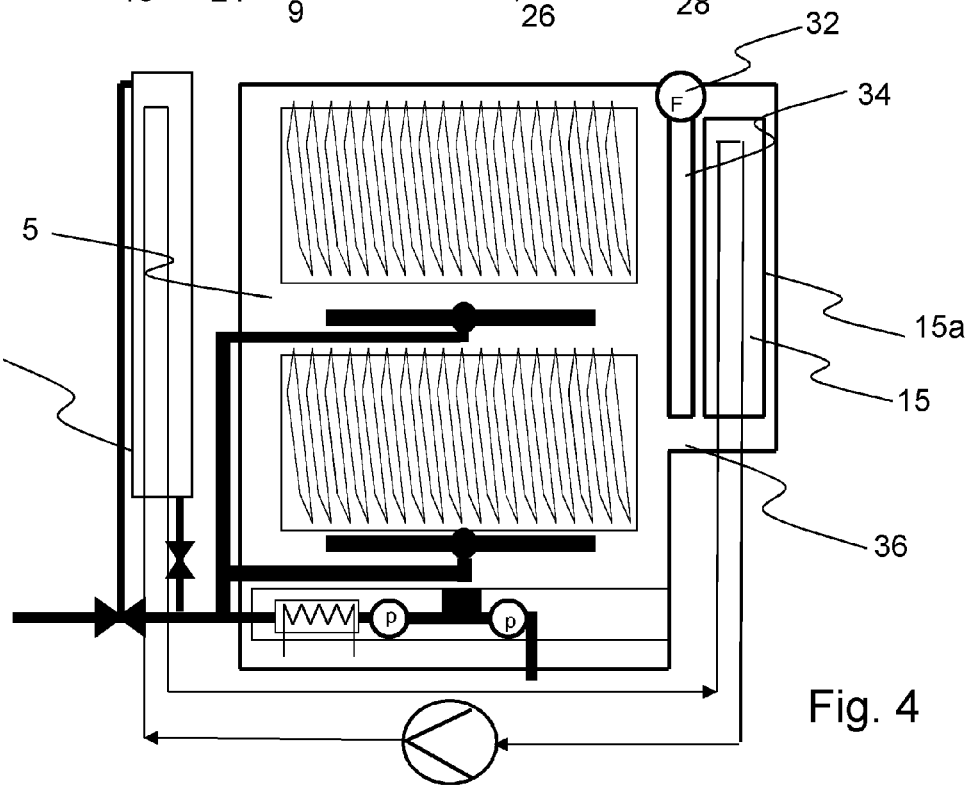
FIG. 4 shows a dishwasher according to another embodiment.

In FIG. 4 another embodiment of a dishwasher is shown. In this embodiment the heat reservoir 15 is arranged directly inside the processing chamber of the dishwasher. The heat reservoir is arranged at the back of the processing chamber 5 behind a partition wall 34. The partition wall separates the heat reservoir from the warm wash fluid in the interior of the processing chamber. The heat reservoir 15 itself has an outer condensing surface 15*a*. The outer surface may be of a metallic material providing excellent heat transfer properties. The condensing surface 15*a*, being in contact with the cooled or frozen liquid inside the reservoir, adapts the temperature of the cooled or frozen liquid. In the drying phase, the warm water vapour from the processing chamber is directed towards the heat reservoir in the same manner as described in relation to FIG. 3.

Figure 5:
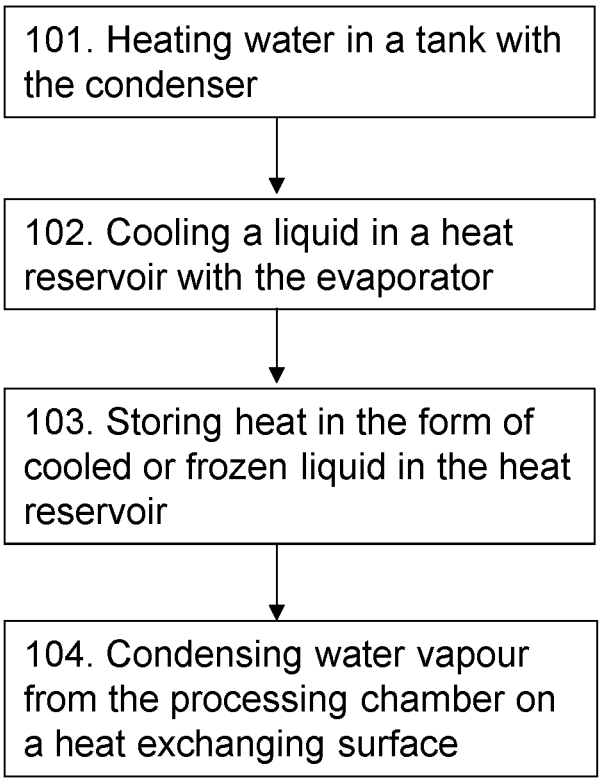
FIG. 5 shows a flow chart of a method for using a heat pump in a household appliance.

FIG. 5 is a flow chart showing a method according to an embodiment. The method steps for using a heat pump in a household appliance will now be described with reference to the flow chart depicted in FIG. 5.

101. Heating water in a tank with the condenser

102. Cooling a liquid in a heat reservoir with the evaporator

103. Storing heat in the form of cooled or frozen liquid in the heat reservoir

104. Condensing water vapour from the processing chamber on a heat exchanging surface arranged in contact with the heat reservoir.

According to the method, storing heat in the form of cooled or frozen liquid takes place in the heat reservoir at the same time as water in the water tank is being warmed by the condenser. In this way an efficient use of the heat pump may be obtained.

By the step of condensing water vapour from the processing chamber humidity is removed from the air in the processing chamber and the goods therein are dried. The heat exchanging surface to condensate on may be available on a heat exchanging device being in connection with the heat reservoir. The heat exchanging surface to condensate on may alternatively be available on the heat reservoir itself.

The invention claimed is:

1. A household appliance for washing and drying goods, comprising a processing chamber for receiving goods to be washed and dried;

a main water inlet fluidly connected to the processing chamber;

a water tank connected to the main water inlet and the processing chamber between the main water inlet and the processing chamber, such that the water tank is configured to receive and hold water from the main water inlet before the water reaches the processing chamber, and a heat pump having a warm side provided with a condenser and a cold side provided with an evaporator, wherein the condenser is adapted to heat water to be used in the processing chamber and the evaporator is adapted to cool a liquid in a heat reservoir for storing heat generated on the cold side of the heat pump during heating with the condenser, wherein the condenser is arranged in the water tank adapted to provide water into the processing chamber, and wherein the heat reservoir is thermally connected to the processing chamber, such that the heat reservoir is configured to cool air in the processing chamber.

2. The household appliance according to claim 1, wherein the heat reservoir is thermally connected to the processing chamber via a heat exchanging device, and the heat exchanging device provides a surface for condensing thereon water vapour from the processing chamber during drying of the goods in the processing chamber.

3. The household appliance according to claim 2, wherein the heat exchanging device comprises a cooling conduit which is connected to the heat reservoir and which is at least partly arranged inside the heat reservoir.

4. The household appliance according to claim 3, wherein the cooling conduit is at least partially arranged inside the processing chamber, such that the cooling conduit is configured to thermally connect the heat reservoir with the processing chamber.

5. The household appliance according to claim 2, wherein the heat exchanging device is a heat pipe or a thermosiphon.

6. The household appliance according to claim 3, wherein the cooling conduit comprises a pump for circulating a heat transfer liquid through the cooling conduit such that the heat transfer liquid is cooled while passing through the heat reservoir.

7. The household appliance according to claim 3, wherein the cooling conduit is spirally shaped in the heat reservoir.

8. The household appliance according to claim 2, wherein the heat exchanging device is arranged within the processing chamber.

9. The household appliance according to claim 2, wherein the heat reservoir is arranged outside the processing chamber.

10. The household appliance according to claim 1, wherein the heat reservoir is arranged within the processing chamber.

11. The household appliance according to claim 10, wherein the heat reservoir comprises a condenser surface onto which water vapour from the processing chamber condenses during drying of the goods in the processing chamber.

12. The household appliance according to claim 1, wherein the appliance comprises an air flow generating device for directing air and/or water vapour towards the heat exchanging device or condenser surface.

13. The household appliance according to claim 1, wherein the liquid in the heat reservoir is water.

14. The household appliance according to claim 1, wherein the household appliance is a dishwasher for washing, rinsing and drying dish goods.

15. The household appliance according to claim 1, wherein the household appliance is a washer-dryer for washing, rinsing and drying laundry.

16. The household appliance according to claim 1, further comprising a partitioning wall in the processing chamber separating a main part of the processing chamber from a cooling area of the processing chamber, and a fan configured to direct air from the main part of the processing chamber to the cooling area of the processing chamber, wherein the heat reservoir is thermally connected to the cooling area of the processing chamber.

17. The household appliance according to claim 1, further comprising at least one valve configured to selectively direct water from the main water inlet to either of the water tank or the processing chamber.

18. The household appliance according to claim 1, further comprising a wash pump configured to circulate liquid from the processing chamber to at least one wash arm, and a heater configured to heat the liquid in the processing chamber proximate the wash pump, wherein the water tank is connected to the wash arm, such that the wash pump and the water tank are each configured to independently supply liquid to the wash arm.

19. A method for using a heat pump in a household appliance, the appliance comprising a processing chamber for receiving goods to be washed and dried, and the heat pump comprising a condenser and an evaporator, the method comprises the steps of:

receiving and holding water in a tank from a main water inlet upstream of the processing chamber, heating the water in the tank with the condenser to be used in the processing chamber, cooling a liquid in a heat reservoir with the evaporator, storing heat in the form of cooled or frozen liquid in the heat reservoir, supplying the heated water in the tank into the processing chamber, and cooling air in the processing chamber with the cooled or frozen liquid in the heat reservoir.

20. The method according to claim 19, wherein the method comprises a further step of:

condensing water vapour from the processing chamber on a heat exchanging surface arranged in contact with the heat reservoir.

* * * * *